US010100452B2

(12) United States Patent
Burgess et al.

(10) Patent No.: US 10,100,452 B2
(45) Date of Patent: Oct. 16, 2018

(54) IMPELLER HAVING A SWEEPER

(71) Applicant: WHIRLPOOL CORPORATION, Benton Harbor, MI (US)

(72) Inventors: Brent Burgess, Edwardsburg, MI (US); Dale Mueller, Haines City, FL (US); Nicholas Vaive, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 455 days.

(21) Appl. No.: 14/885,153

(22) Filed: Oct. 16, 2015

(65) Prior Publication Data

US 2017/0107653 A1 Apr. 20, 2017

(51) Int. Cl.

| | |
|---|---|
| ***D06F 13/00*** | (2006.01) |
| ***D06F 17/06*** | (2006.01) |
| ***D06F 17/10*** | (2006.01) |
| ***D06F 23/04*** | (2006.01) |
| ***D06F 35/00*** | (2006.01) |
| ***D06F 37/14*** | (2006.01) |
| ***D06F 37/40*** | (2006.01) |
| ***F04D 29/22*** | (2006.01) |
| ***F04D 29/24*** | (2006.01) |
| ***D06F 13/02*** | (2006.01) |

(52) U.S. Cl.

CPC ..... *D06F 17/10* (2013.01); *D06F 13/00* (2013.01); *D06F 13/02* (2013.01); *D06F 17/06* (2013.01); *D06F 23/04* (2013.01); *D06F 35/006* (2013.01); *D06F 37/14* (2013.01); *D06F 37/40* (2013.01); *F04D 29/2288* (2013.01); *F04D 29/242* (2013.01)

(58) Field of Classification Search

CPC ..... D06F 13/00; D06F 13/02; D06F 17/06; D06F 17/10; D06F 23/04; D06F 35/006; D06F 37/14; D06F 37/40; F04D 29/2288; F04D 29/242

USPC ..... 68/132, 134

See application file for complete search history.

(56) References Cited

U.S. PATENT DOCUMENTS

| | | | |
|---|---|---|---|
| 4,137,737 | A | 2/1979 | Robandt, II et al. |
| 4,719,770 | A | 1/1988 | Brenner et al. |
| 8,028,850 | B2 | 10/2011 | Zimmerman |
| 8,387,422 | B2 | 3/2013 | Hettinger et al. |
| 8,733,137 | B2 | 5/2014 | Kim et al. |
| D730,603 | S | 5/2015 | Jeon et al. |
| 2012/0144877 | A1 | 6/2012 | Byrne et al. |
| 2013/0340180 | A1 | 12/2013 | Shu et al. |

FOREIGN PATENT DOCUMENTS

CN 101851835 A 10/2010

*Primary Examiner* — Levon J Shahinian

(57) ABSTRACT

An impeller with vanes extending above the upper surface of the impeller base plate along with a sweeper which extends beyond an outer periphery of the base plate. The sweeper pulls clothes from the basket that may have become stuck or lodged in a wet state back in toward the center of the impeller and in turn pushes them up by the impeller vane design.

19 Claims, 4 Drawing Sheets

IMPELLER HAVING A SWEEPER

BACKGROUND

Contemporary laundry treating appliances include vertical axis washing machines having a tub, a basket within the tub defining a treating chamber for the laundry. The tub and basket have aligned top openings that provide access to the treating chamber.

Either an impeller or an agitator are commonly used to impart mechanical energy to the laundry in a vertical axis washing machine. The impeller is more typically used in low water wash systems and relies more on intra-laundry mechanical energy (attributable to the relative laundry movement caused by the impeller) instead of the mechanical energy directly imparted to the laundry from contact with the impeller. The impeller is located within the treating chamber and rotatable about a vertical axis including a base plate with an upper surface including vanes extending above the surface contributes to the mechanical energy necessary to effectively clean the clothes. To effectively wash laundry items in a low water wash system with an impeller, it is helpful for the laundry items to circulate out and back from the center of the impeller. The out and back motion is often in an inverse toroidal motion, with an upward movement at the hub and a downward movement at a periphery of the impeller. In a vertical washing machine with a low profile impeller, an effective movement of the clothes may be hard to obtain particularly in a laundry treating appliance with a reduced level of wash liquid, especially as opposed to a vertical axis agitator with a tall profile.

BRIEF DESCRIPTION OF THE INVENTION

In one aspect, the invention relates to the design of the impeller vanes extending above the upper surface of the impeller base plate along with a sweeper which extends beyond an outer periphery of the base plate. This sweeper essentially pulls clothes from the basket that may have become stuck or lodged in a wet state back in toward the center of the impeller and in turn pushes them up by the impeller vane design. This sweeper allows for a low profile impeller while also allowing for a reduced wash liquid situation which both increases mechanical and chemical energy providing more effective cleaning of the clothes.

DESCRIPTION OF EMBODIMENTS OF THE INVENTION

Figure 1:
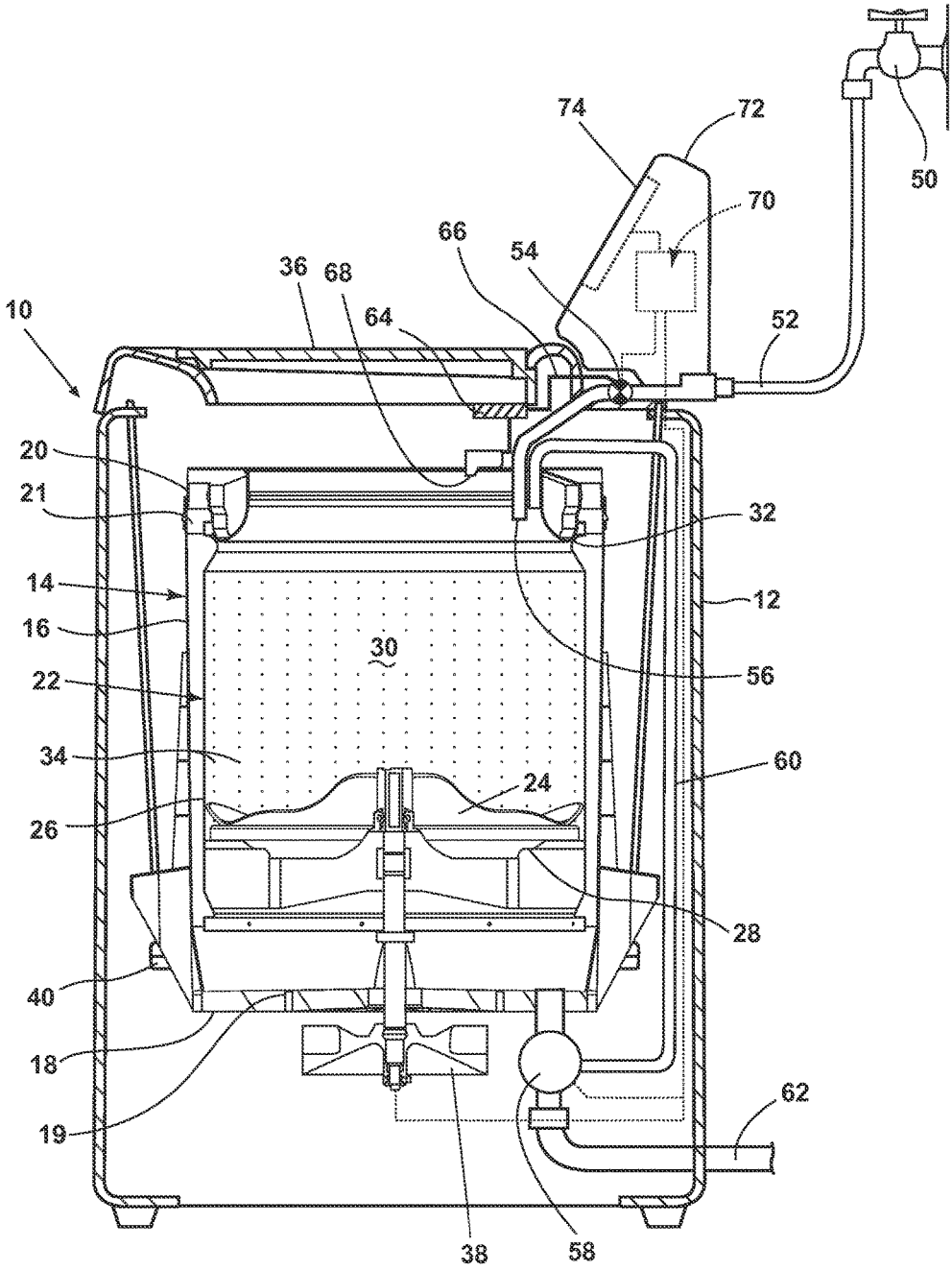
FIG. 1 is a schematic view of a vertical axis washing machine.

FIG. 1 is a schematic view of a laundry treating appliance having an automatic cycle of operation, according to an embodiment of the invention, to reduce the likelihood of contact between a rotating laundry-container and a tub defining a liquid holding reservoir. The laundry treating appliance, or clothes washer, can be any appliance that performs a cycle of operation to clean or otherwise treat items placed therein, non-limiting examples of which include a horizontal or vertical axis clothes washing machine, a combination washing machine and dryer, a tumbling refreshing/revitalizing machine, an extractor, and a non-aqueous washing apparatus.

The laundry treating appliance of FIG. 1 is illustrated as a vertical axis washing machine 10, which can include a structural support system comprising a cabinet 12 that defines a housing within which a laundry holding system resides. The cabinet 12 can be a housing having a chassis and/or a frame, defining an interior receiving components typically found in a conventional washing machine, such as motors, pumps, fluid lines, controls, sensors, transducers, and the like. Such components will not be described further herein except as necessary for a complete understanding of the invention.

The laundry holding system of the illustrated exemplary washing machine 10 can include a watertight tub 14 installed in the cabinet 12. The tub 14 can have a generally cylindrical side or peripheral wall 16 closed at its bottom end 18 that can at least partially define a sump 19. An upper edge 21 of the peripheral wall 16 can define an opening to an interior of the tub 14 for holding liquid.

A rotating laundry-container is illustrated in the form of a perforated basket 22, which can be mounted in the tub 14 for rotation about an axis of rotation, such as, for example, a central, vertical axis extending through the center of a laundry mover in the form of an impeller 24 located within the basket 22. The basket 22 can have a generally cylindrical side or peripheral wall 26 closed at its bottom end by a bottom wall 28 to form an interior at least partially defining a treating chamber 30 receiving a load of laundry items for treatment. The peripheral wall 26 can include a plurality of perforations or apertures 34 such that liquid supplied to the basket 22 can flow through the perforations 34 to the tub 14.

A balance ring 20 can be coupled with an upper edge 32 of the basket peripheral wall 26 to counterbalance a load imbalance that can occur within the treating chamber 30 during a cycle of operation. The top of the cabinet 12 can include a selectively openable lid 36 to provide access into the treating chamber 30 through an open top of the basket 22.

A drive system including a drive motor 38, which can include a gear case, can be utilized to rotate the basket 22 and the impeller 24. The motor 38 can rotate the basket 22 at various speeds, including at a spin speed wherein a centrifugal force at the inner surface of the basket peripheral wall 26 is 1 g or greater; spin speeds are commonly known for use in extracting liquid from the laundry items in the basket 22, such as after a wash or rinse step in a treating cycle of operation. The motor 38 can also oscillate or rotate the impeller 24 about its vertical rotational axis during a cycle of operation in order to provide movement to the load contained within the treating chamber 30. The illustrated drive system for the basket 22 and the impeller 24 is provided for exemplary purposes only and is not limited to that shown in the drawings and described above.

A suspension system 40 can dynamically hold the tub 14 within the cabinet 12. The suspension system 40 can dissipate a determined degree of vibratory energy generated by the rotation of the basket 22 and/or the impeller 24 during a treating cycle of operation. Together, the tub 14, the basket 22, and any contents of the basket 22, such as liquid and laundry items, define a suspended mass for the suspension system 40. The suspension system 40 can be any type of suspension system.

The washing machine 10 can be fluidly connected to a liquid supply 50 through a liquid supply system including a liquid supply conduit 52 having a valve assembly 54 that can be operated to selectively deliver liquid, such as water, to the tub 14 through a liquid supply outlet 56, which is shown by example as being positioned at one side of the tub 14. The washing machine 10 can further include a recirculation and drain system having a pump 58 that can pump liquid from the tub 14 back into the tub 14 through a recirculation conduit 60 for recirculation of the liquid and/or to a drain conduit 62 to drain the liquid from the washing machine 10. The illustrated liquid supply system and recirculation and drain system for the washing machine 10 are provided for exemplary purposes only and are not limited to those shown in the drawings and described above.

The washing machine 10 can also be provided with a dispensing system for dispensing treating chemistry to the basket 22, either directly or mixed with water from the liquid supply system, for use in treating the laundry according to a cycle of operation. The dispensing system can include a dispenser 64 which can be a single use dispenser, a bulk dispenser, or a combination of a single use and bulk dispenser. Water can be supplied to the dispenser 64 from the liquid supply conduit 52 by directing the valve assembly 54 to direct the flow of water to the dispenser 64 through a dispensing supply conduit 66. Additionally, the dispenser 64 can fluidly couple to the basket access opening through a dispenser outlet 68.

The washing machine 10 can also be provided with a heating system (not shown) to heat liquid provided to the treating chamber 30. In one example, the heating system can include a heating element provided in the sump 19 to heat liquid that collects in the sump 19. Alternatively, the heating system can be in the form of an in-line heater that heats the liquid as it flows through the liquid supply, dispensing, and/or recirculation systems.

The liquid supply, dispensing, and recirculation and drain systems can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry. For example, the liquid supply system and/or the dispensing system can be configured to supply liquid into the interior of the tub 14 not occupied by the basket 22 such that liquid can be supplied directly to the tub 14 without having to travel through the basket 22.

The washing machine 10 can further include a control system for controlling the operation of the washing machine 10 to implement one or more treating cycles of operation. The control system can include a controller 70 located within a console 72 or elsewhere, such as within the cabinet 12, and a user interface 74 that is operably coupled with the controller 70. The user interface 74 can include one or more knobs, dials, switches, displays, touch screens, and the like for communicating with the user, such as to receive input and provide output. The user can enter different types of information including, without limitation, cycle selection and cycle parameters, such as cycle options.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
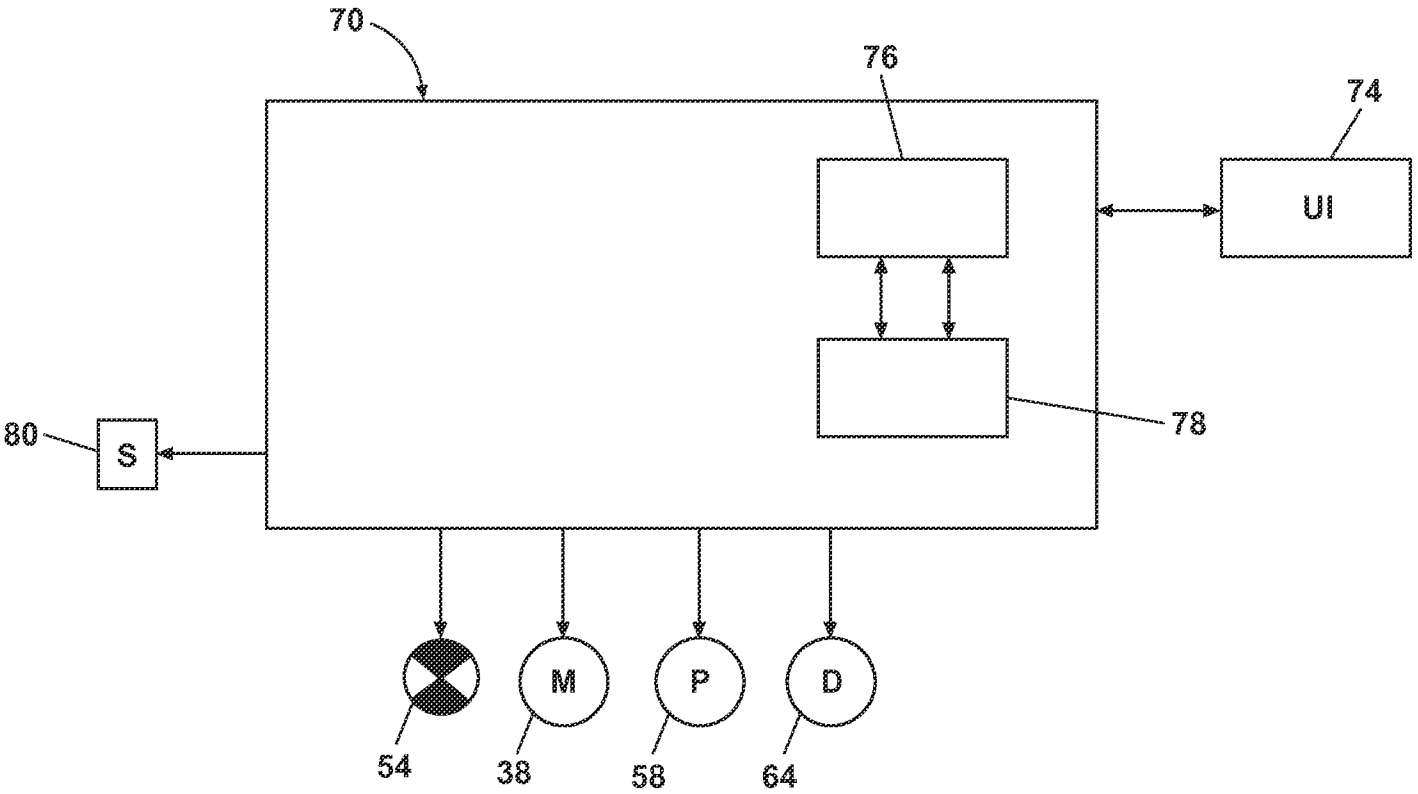
FIG. 2 is a schematic of a control system for the dryer of FIG. 1.

As illustrated in FIG. 2, the controller 70 can be provided with a memory 76 and a central processing unit (CPU) 78. The memory 76 can be used for storing the control software that is executed by the CPU 78 in completing a treating cycle of operation using the washing machine 10 and any additional software. Examples, without limitation, of treating cycles of operation include: wash, heavy duty wash, delicate wash, quick wash, pre-wash, refresh, rinse only, and timed wash. The memory 76 can also be used to store information, such as a database or table, and to store data received from one or more components of the washing machine 10 that can be communicably coupled with the controller 70. The database or table can be used to store the various operating parameters for the one or more cycles of operation, including factory default values for the operating parameters and any adjustments to them by the control system or by user input. Such information or operating parameters stored in the memory 76 can also include acceleration ramps, threshold values, predetermined criteria, etc.

The controller 70 can be operably coupled with one or more components of the washing machine 10 for communicating with and controlling the operation of the component to complete a cycle of operation. For example, the controller 70 can be operably coupled with the motor 38, the valve assembly 54, the pump 58, the dispenser 64, and any other additional components that can be present such as a steam generator and/or a sump heater (not shown) to control the operation of these and other components to implement one or more of the cycles of operation. The controller 70 can also be coupled with one or more sensors 80 provided in one or more of the systems of the washing machine 10 to receive input from the sensors, which are known in the art and not shown for simplicity. Such sensors 80 can include a motor torque sensor, a speed sensor, an acceleration sensor, and/or a position sensor providing an output or signal indicative of the torque applied by the motor 38, a speed of the basket 22 or component of the drive system, an acceleration of the basket 22 or component of the drive system, and a position sensor of the basket 22.

Figure 3:
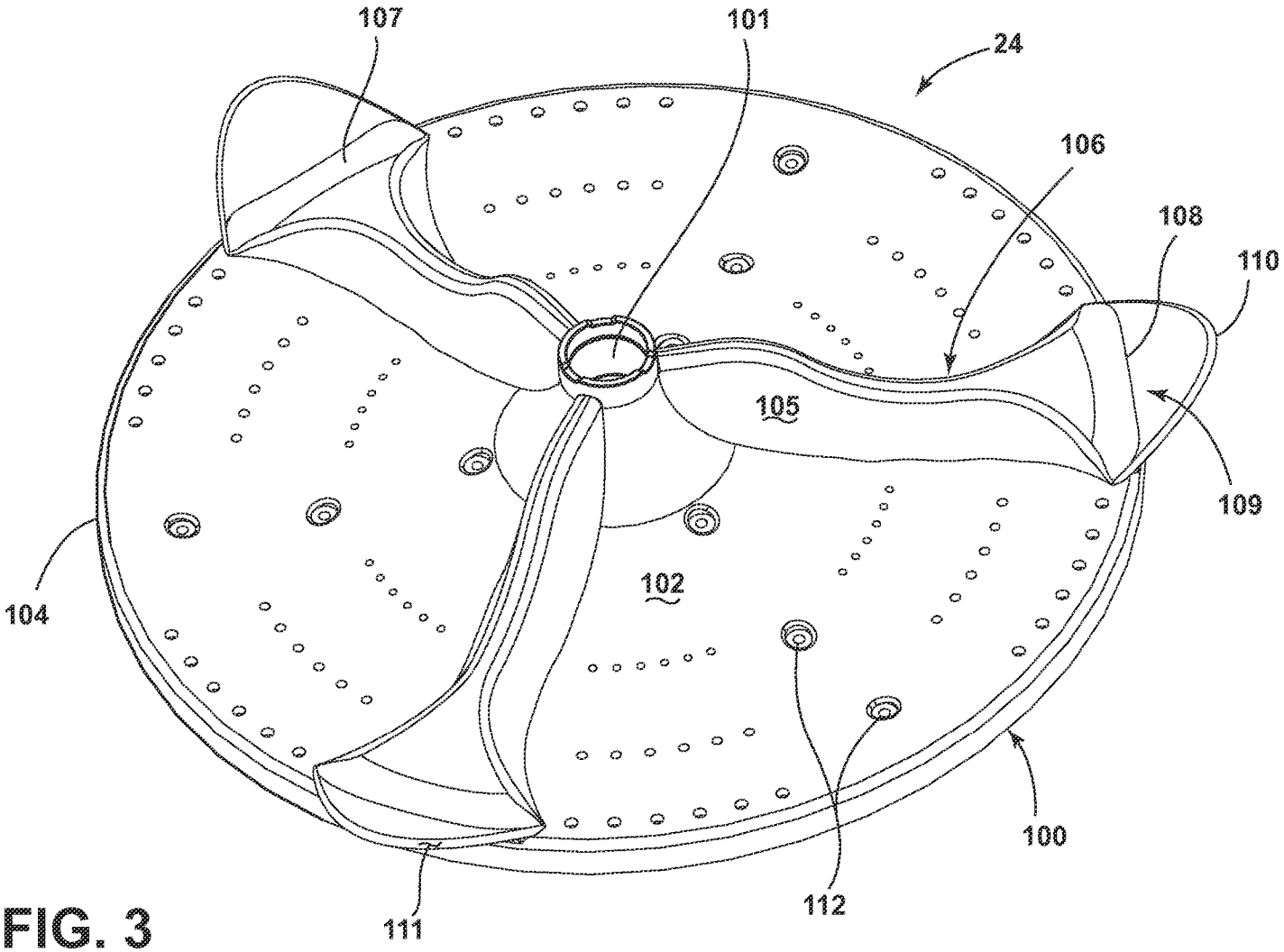
FIG. 3 is a perspective view of the impeller for the washing machine of FIG. 1.

A detailed figure of the impeller 24 is illustrated in FIG. 3. The impeller includes an annular base plate 100 having an upper surface 102 and a periphery 104. At least one vane assembly 106 extends upwardly from the upper surface 102. As illustrated, there are three vane assemblies evenly distributed radially about the central hub which defines the axis 101. Any number of vane assemblies 106 can be used. It is contemplated that for the given diameter of the base plate 100 that the practical useful number of vane assemblies can be up to six. Room for these additional assemblies is illustrated by the line of screw bosses 112 extending radially from the central hub which defines the axis 101 and centrally located between the existing vane assemblies 106. Similar screw bosses 112 are found under the vane assemblies 106.

The vane assembly 106 includes a vane with a first body 105 extending in a vertical plane above the base plate 100 and extending radially from the central hub which defines the axis 101 toward the periphery 104. As the vane body 105 nears the periphery 104, the vane fans out when viewed in a horizontal plane to form a second body 107. The second body 107 terminates in a radially outwardly diverging portion 108. A rigid sweeper 109 extends from the diverging portion 108 and terminates in an outwardly extending rounded tip 110 in an arc shape.

Figure 4:
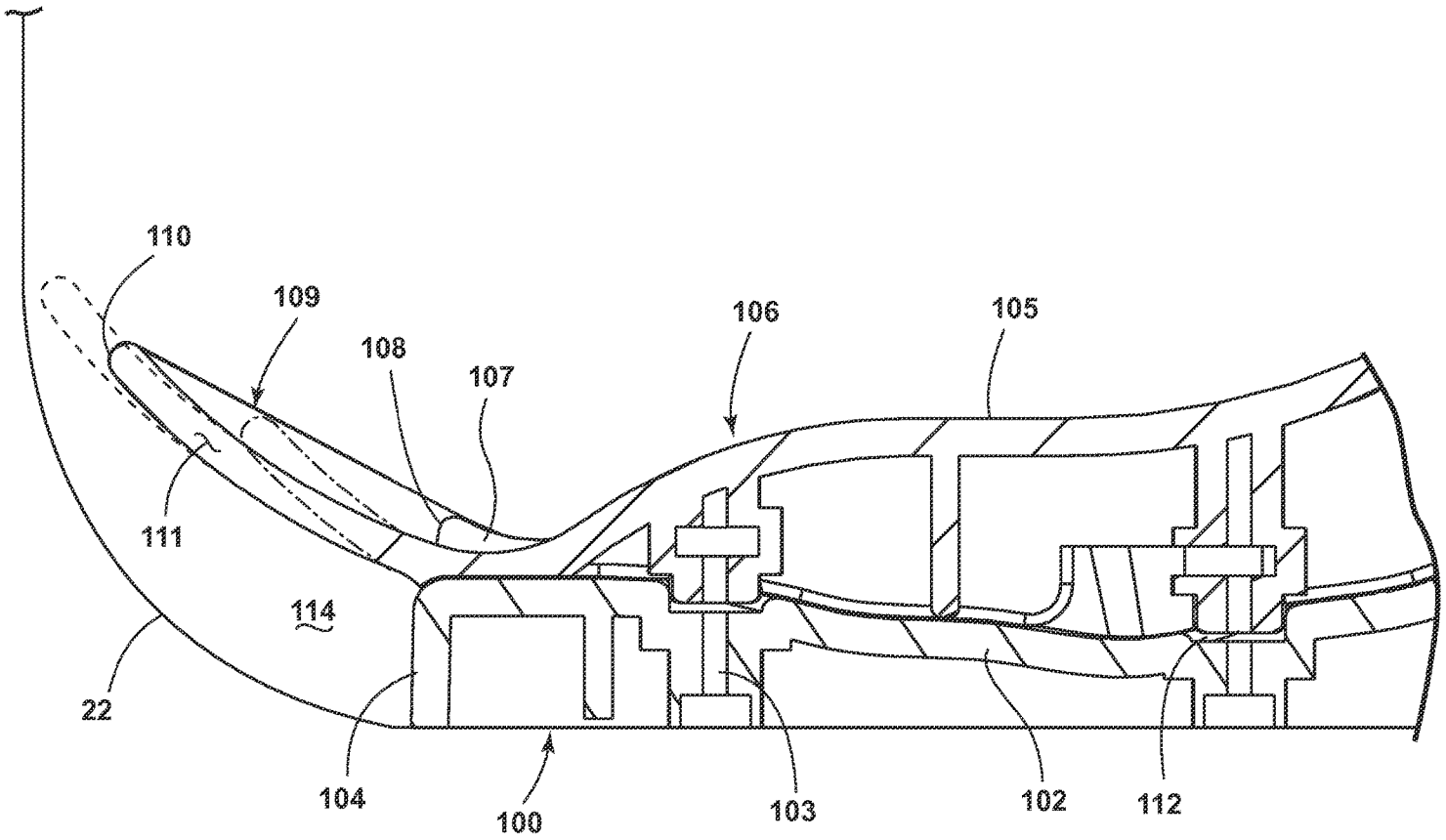
FIG. 4 is a side view of the impeller of FIG. 3.

Referring to FIG. 4, each sweeper 109 is shaped so as to form an upturned lip 111 when viewed in a side profile. The profile of the sweeper 109 is such that the lip 111 follows the corresponding profile of the basket leaving a small gap 114 between the sweeper 109 and basket 22. The proximity of the sweeper 109 to the basket 22 along with the profile of the sweeper 109 allow the sweeper to pick up any laundry items that become lodged to the basket 22 as the impeller 24 turns, essentially freeing them from the laundry basket to keep them in motion.

The vane assembly 106 is mounted to the base plate 100 in a conventional way such as by screws 103 through the upper surface 102 by way of the screw bosses 112 as illustrated in FIG. 4. Once mounted, the vane assembly 106 and base plate 100 form a unitary structure comprising the impeller 24. The vane assembly 106 consisting of the first vane body 105, second vane body 107, and sweeper 109 is injection molded as one singular piece out of polypropylene, or the like, creating a rigid vane assembly 106.

While the sweeper 109 length can vary in different embodiments, the exemplary lengths illustrated by dotted lines are 6 mm, 12 mm, and 24 mm in FIG. 4. In a standardized cleaning test the lengths improved the cleaning performance by 1, 4, and 5 points respectively on a scale of 100 when compared with a standardized definition of clean. When the laundry treating appliance is in operation, when the impeller 24 rotates, the sweeper 109 picks up clothes from the peripheral wall 26 after which the vane body 105 pulls them back in toward the central hub which defines the axis 101 where they are then forced up. This process generates more mechanical action than a laundry treating appliance without sweepers, increasing mechanical energy. A conventional laundry treating appliance with a low profile impeller can allow laundry to become lodged on the basket where it remains stuck or moves very slowly out of the lodged position between the periphery of the base plate and the transitional curve from the bottom to the side of the basket. Any laundry stuck in such a position receives less mechanical action and therefore does not become as clean. While increasing the diameter of the base plate may provide a solution to this problem as well, doing so would create a much larger torque on the motor, requiring a larger motor, or a shorter life-span for an existing motor. The sweeper 109 solves this problem without substantially increasing the torque on the motor to the point where a larger motor is needed is life span is appreciably shortened.

The increase in mechanical action also eliminates the need to float clothes thus saving, in certain implementations, an extra 2 gallons of water for each cycle, or 4 gallons for each load. With less water in the laundry treating appliance, the detergent concentration is increased as well, increasing the chemical energy and allowing for cleaner clothes in less time.

The disclosed embodiments of the impeller can be applied to other exemplary types of laundry movers including, but not limited to, an agitator, a wobble plate, and a hybrid impeller/agitator. While the invention has been specifically described in connection with certain specific embodiments thereof, it is to be understood that this is by way of illustration and not of limitation, and the scope of the appended claims should be construed as broadly as the prior art will permit.

The invention claimed is:

1. A laundry treating appliance for treating laundry according to an automatic cycle of operation, comprising:
- a tub defining a liquid-holding reservoir;
- a basket located within the reservoir and comprising a bottom wall from which extends a peripheral wall, and a corner that transitions between a substantially flat portion of the bottom wall and a vertical portion of the peripheral wall, which collectively define at least a portion of a treating chamber for receiving laundry to be treated;
- an impeller located within the treating chamber and rotatable about a vertical rotational axis and comprising:
  - a base plate having an upper surface and an outer periphery; and
  - at least one vane assembly having a vane extending above the upper surface and a sweeper extending from the vane beyond the outer periphery and overlying at least a portion of the corner to pick up any laundry items that become lodged to the basket;
- wherein the vane has a first body plane with a vertical orientation, and the sweeper is rigid and has a second body plane with a horizontal orientation.

2. The laundry treating appliance of claim 1 wherein the sweeper and vane form a unitary structure.

3. The laundry treating appliance of claim 2 wherein the sweeper and vane are integrally formed as the unitary structure.

4. The laundry treating appliance of claim 1 wherein the vane extends radially outward toward the periphery and terminates in a radially outwardly diverging portion, and the sweeper extends radially outwardly from the outwardly diverging portion.

5. The laundry treating appliance of claim 4 wherein the sweeper terminates in an outwardly extending rounded tip.

6. The laundry treating appliance of claim 5 wherein the rounded tip defines an arc.

7. The laundry treating appliance of claim 6 wherein the rounded tip is shaped to define an upturned lip in side profile.

8. The laundry treating appliance of claim 7 wherein the upturned lip follows a corresponding profile of the basket.

9. The laundry treating appliance of claim 8 wherein the corresponding profile of the basket is a curve.

10. The laundry treating appliance of claim 1 wherein the sweeper defines an upturned lip in side profile.

11. The laundry treating appliance of claim 10 wherein the upturned lip follows a corresponding profile of the basket.

12. The laundry treating appliance of claim 11 wherein the corresponding profile of the basket is a curve.

13. The laundry treating appliance of claim 1 wherein the at least one vane assembly comprises multiple, radially spaced vane assemblies.

14. A laundry treating appliance for treating laundry according to an automatic cycle of operation, comprising:
- a tub defining a liquid-holding reservoir;
- a basket located within the reservoir and comprising a bottom wall from which extends a peripheral wall, and a corner that transitions between a substantially flat portion of the bottom wall and a vertical portion of the peripheral wall, which collectively define at least a portion of a treating chamber for receiving laundry to be treated; and
- an impeller located within the treating chamber and rotatable about a rotational axis and comprising:
  - a base plate having an upper surface and an outer periphery;
  - a vane extending above the upper surface; and a rigid sweeper having a horizontal orientation and extending from the vane beyond the outer periphery and overlying at least a portion of the corner to pick up any laundry items that become lodged to the basket.

15. The laundry treating appliance of claim 14 wherein the sweeper defines an upturned lip in side profile.

16. The laundry treating appliance of claim 15 wherein the upturned lip follows a corresponding profile of the basket.

17. An impeller for a clothes washer having a basket comprising a bottom wall from which extends a peripheral wall, and a corner that transitions between a flat portion of the bottom wall and a vertical portion of the peripheral wall, the impeller comprising:

a base plate having an upper surface and an outer periphery; and at least one vane assembly having a vane extending above the upper surface and a sweeper extending from the vane beyond the outer periphery and overlying at least a portion of the corner to pick up any laundry items that become lodged to the basket;

wherein the vane has a first body plane with a vertical orientation, and the sweeper is rigid and has a second body plane with a horizontal orientation.

18. The impeller of claim 17 wherein the sweeper defines an upturned lip in side profile.

19. The impeller of claim 17 wherein the sweeper is integrally formed with the vane.

* * * * *